US007452855B2

(12) United States Patent
Hubig et al.

(10) Patent No.: US 7,452,855 B2
(45) Date of Patent: Nov. 18, 2008

(54) FRAGRANCE DISPENSER FOR A DRYER AND A METHOD FOR DISPENSING FRAGRANCE ONTO FABRIC IN A DRYER

(75) Inventors: Stephan M. Hubig, Maplewood, MN (US); Jaclyn Joy Steep, Woodbury, MN (US)

(73) Assignee: Ecolab Inc., St. Paul, MN (US)

( * ) Notice: Subject to any disclaimer, the term of this patent is extended or adjusted under 35 U.S.C. 154(b) by 468 days.

(21) Appl. No.: 11/106,384

(22) Filed: Apr. 14, 2005

(65) Prior Publication Data

US 2006/0234884 A1 Oct. 19, 2006

(51) Int. Cl.
*C11D 3/37* (2006.01)
*C11D 3/50* (2006.01)

(52) U.S. Cl. ..... 510/519

(58) Field of Classification Search ..... 510/519
See application file for complete search history.

(56) References Cited

U.S. PATENT DOCUMENTS

| | | | | |
|---|---|---|---|---|
| 2,807,893 | A | 10/1957 | Morey | |
| 3,442,692 | A | 5/1969 | Gaiser | |
| 3,686,025 | A | 8/1972 | Morton | |
| 4,073,996 | A | 2/1978 | Bedenk et al. | |
| 4,184,099 | A | 1/1980 | Lindauer et al. | |
| 4,604,114 | A | 8/1986 | Ward | |
| 4,834,895 | A | 5/1989 | Cook et al. | |
| 4,837,421 | A | 6/1989 | Luthy | |
| 5,041,230 | A | 8/1991 | Borcher, Sr. et al. | |
| 5,145,595 | A | 9/1992 | Morris et al. | |
| 5,234,610 | A | 8/1993 | Gardlik et al. | |
| 5,366,881 | A | 11/1994 | Singh | |
| 5,749,163 | A | 5/1998 | Staub et al. | |
| 5,820,791 | A | 10/1998 | Canale | |
| 5,937,140 | A | 8/1999 | Leonard et al. | |
| 6,044,202 | A | 3/2000 | Junkel | |
| 6,289,176 | B1 | 9/2001 | Martter et al. | |
| 6,503,077 | B2 | 1/2003 | Orth et al. | |
| 6,584,633 | B2 | 7/2003 | Chute et al. | |
| 6,609,311 | B2 * | 8/2003 | Hagemann et al. | 34/597 |
| 6,779,740 | B1 | 8/2004 | Lentsch et al. | |
| 2003/0065084 | A1 | 4/2003 | MacQueen et al. | |
| 2003/0192197 | A1 | 10/2003 | Griese et al. | |
| 2003/0195130 | A1 | 10/2003 | Lentsch et al. | |
| 2003/0224965 | A1 | 12/2003 | Conley et al. | |
| 2004/0018623 | A1 | 1/2004 | Rosenberg | |
| 2004/0089731 | A1 | 5/2004 | Greise et al. | |
| 2004/0159717 | A1 | 8/2004 | Griese et al. | |
| 2004/0159718 | A1 | 8/2004 | Griese et al. | |
| 2004/0167056 | A1 | 8/2004 | Lentsch et al. | |
| 2004/0235705 | A1 | 11/2004 | Popplewell et al. | |
| 2005/0045736 | A1 | 3/2005 | Griese et al. | |

FOREIGN PATENT DOCUMENTS

| | | | |
|---|---|---|---|
| DE | 195 43 337 | A1 | 5/1997 |
| DE | 102 37 066 | A1 | 2/2004 |
| EP | 334490 | A2 * | 2/1989 |
| EP | 1 178 107 | A2 | 2/2002 |
| EP | 0939782 | B1 | 8/2004 |
| WO | WO 2005/012408 | A2 | 2/2005 |
| WO | WO 2005/085404 | A1 | 9/2005 |

OTHER PUBLICATIONS

"Eastman Chemical: Gee, your plsatic smells nice! Eastman's material difference lets designers explor another dimension—scent," Packaging Digest, © 2004, pp. 1-2.
"Scented and Flavored Packaging," http://www.scentsationaltechnologies.com, 1 Page, Date Unknown.
"Polyscent Fragrances," http://www.polyvel.com/polyscent.html, 1 Page, Date Unknown.
"Fragrance Products Formulated with Pemulen® Polymeric Emulsifiers," B.F. Goodrich, Apr. 1999, pp. 1-3.
"Plastic Air Freshener," www.shamood.com, pp. 1-2, Date Unknown.
"Sink Daisy," http://www.ekitchengadgets.com, pp. 1-2, Date Unknown.
"Scented Plastic," http://www.inventables.com, pp. 1-2, © 2004.
"Scented Compounds," RTP Company, pp. 1-2, Date Unknown.
"Polymers & Carriers," Alpha Aromatics, pp. 1-3, © 2003.
Escher S. et al., "A Quantitative Study of Factors That Influence The Substantivity Of Fragrance Chemicals On Laundered And Dried Fabrics," JAOCS, vol. 71, No. 1, pp. 31-40, Jan. 1994.
"Dry Fragrance Concentrates," Modern Plastics; 61, No. 4, p. 140, Apr. 1984—Abstract Only.
Booma, M. et al., "Permeability Of Fragrance Volatiles Through An Ethylene-Vinyl Acetate Co-Polymer Membrane Based Delivery System: The Effect Of Time And Temperature," Paper Presented at 1993, Polymers, Laminations and Coatings Conference, Chicago, IL, pp. 225-261, Aug. 29 through Sep. 2, 1993. Abstract Only.

* cited by examiner

*Primary Examiner*—John R Hardee
(74) *Attorney, Agent, or Firm*—Andrew D. Sorensen; Anneliese S. Mayer; Amy J. Hoffman

(57) ABSTRACT

A fragrance dispenser is provided according to the invention. A fragrance dispenser is provided for use in a dryer for dispensing a fragrance onto fabric or laundry dried in the dryer. The fragrance dispenser includes a mixture of a carrier component and a fragrance component so that the fragrance dispenser is provided in a solid form. The carrier component and the fragrance component are selected so that, when the fragrance dispenser is placed in a dryer and contacts fabric being dried during a drying cycle at a temperature of up to about 170° F., the carrier component does not flow onto the fabric and the fragrance component dispenses in an amount sufficient to impart a residual fragrance to the fabric. A method for dispensing fragrance onto fabric in a dryer is provided.

14 Claims, No Drawings

FRAGRANCE DISPENSER FOR A DRYER AND A METHOD FOR DISPENSING FRAGRANCE ONTO FABRIC IN A DRYER

FIELD OF THE INVENTION

The invention relates to a fragrance dispenser for a dryer and to a method for dispensing fragrance onto fabric in a dryer. The fragrance dispenser can be placed inside the dryer, and can dispense fragrance onto the fabric in the dryer to provide the fabric with a residual fragrance as a result of the temperature achieved in the dryer during the drying cycle. The fragrance dispenser can be constructed for use in a single drying cycle, or the fragrance dispenser can be constructed for use in multiple drying cycles.

BACKGROUND OF THE INVENTION

Air fresheners are commonly available for dispensing a fragrance into a particular environment such as a room or passenger area of a motor vehicle.

Air fresheners are available that plug into an electrical outlet and rely upon a small degree of electrical heating to dispense fragrance. Exemplary air fresheners that plug into electrical outlets are commercially available under the names GLADE PLUGINS, AIR WICK, and RENUZIT SCENTED OIL AIRLETS. Exemplary patent documents disclosing plug-in air fresheners include U.S. Pat. No. 5,937,140 to Leonard et al., U.S. Pat. No. 6,044,202 to Jankel, and U.S. Pat. No. 4,837,421 to Luthy.

Dryer sheets are available for dispensing fabric softener and fragrance onto laundry during a drying cycle in a dryer. Dryer sheets are generally considered to be single use dryer sheets and can be disposed of after each use in a dryer. Exemplary dryer sheets are commercially available under the names BOUNCE, SNUGGLE, DOWNY, ALL, GAIN, and CUDDLE SOFT. Dryer sheets are disclosed by U.S. Pat. No. 3,442,692 to Gaiser, U.S. Pat. No. 3,686,025 to Morton, U.S. Pat. No. 4,834,895 to Cook et al., U.S. Pat. No. 5,041,230 to Borcher, Sr., et al., and U.S. Pat. No. 5,145,595 to Morris et al.

Various techniques have been developed for mechanically imparting a fragrance onto laundry. For example, see U.S. Pat. No. 6,584,633 to Chute et al., and U.S. patent application Publication No. U.S. 2003/0224965 to Conley et al.

SUMMARY

A fragrance dispenser is provided according to the invention. A fragrance dispenser is provided for use in a dryer for dispensing a fragrance onto fabric or laundry dried in the dryer. The fragrance dispenser includes a mixture of a carrier component and a fragrance component so that the fragrance dispenser is provided in a solid form. The carrier component and the fragrance component are selected so that, when the fragrance dispenser is placed in a dryer and contacts fabric being dried during a drying cycle at a temperature of up to about 170° F., the carrier component does not flow onto the fabric, and the fragrance component dispenses in an amount sufficient to impart a residual fragrance to the fabric.

A method for dispensing fabric onto laundry in a dryer is provided according to the invention. The method includes a step of drying fabric in an automatic dryer in the presence of a fragrance dispenser at a dryer temperature of at least about 100° F. to provide release of fragrance from the fragrance dispenser to impart a residual fragrance to the fabric.

DETAILED DESCRIPTION

A fragrance dispenser can be provided for dispensing fragrance onto fabric during a drying cycle in a dryer to impart a residual fragrance to the fabric. The phrase "residual fragrance" refers to a fragrance that can be detected on the fabric at least 24 hours after the drying operation. For example, more than 50% of a panel of at least nine people can detect the presence of a residual fragrance on towels at least 24 hours after the towels are dried in a dryer in the presence of the fragrance dispenser.

The term "fabric" refers to any textile that can be processed in a dryer for the removal of water. Fabrics are often referred to as laundry in the case of industrial and domestic (or residential) laundry operations. Exemplary laundry items include towels, bed sheets, and clothing. Exemplary articles of clothing or garments laundered at an industrial laundering facility include robes, uniform shirts, uniform pants, executive shirts, lab coats, aprons, jackets, and shop coats. The reference to fabric includes items or articles that include fabric. Items or articles that include fabric can include athletic shoes, accessories, stuffed animals, brushes, mats, hats, gloves, outerwear, tarpaulins, tents, and curtains.

The fragrance dispenser can be formulated to be used in domestic (or residential) dryers, industrial dryers, or both domestic dryers and industrial dryers. The dryers may be gas, electric, or steam powered. In general, residential dryers refer to those dryers that are typically purchased for home use. Residential dryers can be referred to as home style dryers. Industrial dryers are often used by companies in the laundry cleaning business. Domestic dryers and industrial dryers are available that operate under various conditions depending upon the model selected, the type of heat source generated, and the desired operating conditions. In general, residential dryers often achieve a drying temperature in the range of about 100° F. to about 160° F., and industrial dryers often achieve a temperature in the range of about 170° F. to about 240° F. It should be understood that these ranges are not necessarily strictly adhered to. Domestic dryers and industrial dryers can operate at lower temperatures or higher temperatures as desired.

The fragrance dispenser can be constructed so that it resists dispensing fragrance under ambient conditions such as room temperature, dispenses fragrance during operation of the dryer once an activation temperature is achieved, and remains as a solid so that the carrier component does not transfer to the fabric under drying conditions. The fragrance dispenser can be provided so that it operates under the conditions encountered in a domestic dryer, under the conditions encountered in an industrial dryer, or under conditions encountered in both a domestic dryer and an industrial dryer. For example, the fragrance dispenser can be provided so that it operates to dispense a desired dose when provided in a dryer operating at a dryer temperature of at least about 100° F. Furthermore, the fragrance dispenser can be provided so that it dispenses a fragrance when provided in a dryer at a drying temperature of at least about 170° F. The fragrance dispenser can be constructed so that it does not dispense a dose when provided in a dryer during a dryer operation at a dryer temperature of less than 100° F. or less than 170° F. Accordingly, the fragrance dispenser can be constructed for use in a domestic dryer so that it dispenses a dose during a drying cycle at a drying temperature in the range of about 100° F. to about 160° F., and can be constructed so that it dispenses a dose during a drying cycle in an industrial dryer during a drying cycle at a drying temperature of about 170° F. to about 240° F., or the fragrance dispenser can be constructed so that it operates to dispense a dose during a drying cycle during operation of both a domestic dryer and an industrial dryer.

The fragrance dispenser includes at least two components. The first component can be referred to as the carrier component and the second component can be referred to as the fragrance component. The carrier component can be responsible for holding the fragrance component in a solid form and allowing a controlled release of the fragrance component once the environment containing the solid form has reached an activation temperature. The carrier component can be selected to provide containment and controlled release of the fragrance component, and so that the carrier component does not transfer to fabrics in the dryer during operation of the dryer. The fragrance component can be selected so that it dispenses from the fragrance dispenser at the activation temperature to impart a residual fragrance on fabric subjected to drying in the dryer. In addition, the fragrance component can be selected so that a desired amount or dose of the fragrance component can be released from the fragrance dispenser during a drying cycle. If all or almost all of the fragrance component dispenses during a single drying cycle, the fragrance dispenser may be useful as a single use fragrance dispenser. In addition, the fragrance dispenser can be useful as a single use fragrance dispenser if a dose is dispensed during a single drying cycle and subsequent use of the fragrance dispenser during a drying cycle does not amount to dispensing of a dose of the fragrance component. If the fragrance dispenser releases a dose of the fragrance component during multiple drying cycles, the fragrance dispenser can be characterized as a multiple use fragrance dispenser.

The carrier component and the fragrance component can be selected so that they are compatible. The term "compatible" refers to the lack of a reaction or other type of deleterious interaction between the carrier component and the fragrance component that may impair the carrier component or the fragrance component, and refers to a level of mixing of the carrier component and the fragrance component so that the fragrance component can be released from the fragrance dispenser to provide a desired dose of the fragrance dispenser once the activation temperature is reached during a drying cycle in a laundry dryer. The term "compatible" refers to an ability of the fragrance component to migrate through the fragrance dispenser over time to provide a controlled release of the fragrance component so that the fragrance dispenser imparts a desired level of residual fragrance to fabric dried in the dryer, even after multiple cycles.

The carrier component of the fragrance dispenser can be selected so that the fragrance dispenser does not melt during operating conditions of the dryer into which the fragrance dispenser is placed. In reference to the fragrance dispenser, the term "melt" or "melting" refers to the carrier component transferring to the fabric during a drying operation. Transfer of the carrier component onto the fabric during a drying operation can result in damage to the fabric. When provided for use in a domestic dryer, the carrier component can be selected so that it does not flow onto the fabric being dried in the domestic dryer at temperatures up to about 170° F. In addition, the carrier component can be selected so that when the fragrance dispenser is placed in an industrial dryer at a drying temperature up to about 240° F., the carrier component does not flow onto the fabric being dried in the industrial dryer. It should be understood that the reference to "drying temperature" refers to the temperature achieved within the dryer during a drying cycle.

The carrier component can be selected so that the fragrance dispenser releases a desired amount of the fragrance component during a drying cycle. For a single use application, the carrier component can be selected so that essentially all of the fragrance component is released from the fragrance dispenser. In the case of a multiple use fragrance dispenser, the carrier component can be selected so that a desired amount or dose of the fragrance component is released during each drying cycle during the useful life of the fragrance dispenser. It should be understood that at some point, the fragrance dispenser will stop releasing a desired amount or dose of fragrance component onto the laundry. Once the fragrance dispenser stops releasing a desired amount or dose of the fragrance component onto the laundry, the fragrance dispenser can be considered exhausted and can be replaced with a new fragrance dispenser. The exhausted fragrance dispenser can be discarded. The desired amount of the fragrance component that results in a residual fragrance can be referred to as a dose. For a multiple use fragrance dispenser, it is desirable for the dispenser to provide a fragrance dose during at least 10 drying cycle. The fragrance dispenser can be provided so that it doses fragrance during at least about 20 cycles in a laundry dryer, and can be provided so that it doses fragrance during at least about 50 cycles in a laundry dryer.

The dose of a fragrance component refers to an amount and type of fragrance that provides a residual fragrance to the textiles dried that can be detected on the fabric at least 24 hours after the drying operation. For example, more than 50% of a panel of at least nine people can detect the presence of a fragrance on towels at least 24 hours after the towels are dried in a dryer in the presence of the fragrance dispenser wherein the fragrance dispenser is dispensing a desired amount or dose of the fragrance component. Preferably, the fragrance dispenser can satisfy a panel test where at least six of nine panelists correctly identify the towel, from a group of three towels, that is different. Either one towel or two towels of the three towels are dried in a dryer in the presence of the fragrance dispenser at least 24 hours earlier. The other towel or towels are not dried in the presence of a fragrance dispenser. The panelists are asked to identify the towel that is different from the other two towels without being told that the difference relates to fragrance. The panelists that can detect the presence of residual fragrance either select the towel that has no residual fragrance if the other two towels have a residual fragrance or select the towel that has the residual fragrance is the two other towels do not have residual fragrance. This type of panel test can be referred to as a "triangle test." It should be understood that the panelists are individuals not suffering from an impairment of olfactory sense from, for example, illness or activity that may limit one's ability to detect fragrance (e.g., smoking or exposure to certain chemicals).

The carrier component of the fragrance dispenser can be any polymer component that mixes with the fragrance component to provide a solid fragrance dispenser that releases the fragrance component over time as a result of heating the fragrance dispenser to an activating temperature. The selection of the carrier component may depend on the selection of the fragrance component. That is, various fragrance components may be more compatible or suitable for use with certain types of carrier components. Exemplary polymers that can be used as the carrier component include polyamides, polyolefins, functionalized polyolefins, polyacrylates, polysaccharides, or mixtures thereof. Exemplary polyamides include fatty polyamides such as those available under the name VERSALON from General Mills and VERSAMID from Cognis, ester terminated polyamides such as those available under the names UNICLEAR 100 and UNICLEAR 100V from Arizona Chemical, polyolefins such as polyethylene, polypropylene, or mixtures of polyethylene and polypropylene, functionalized polyolefins such as polyvinyl chloride, polyvinyl acetate, or polyvinyl alcohol, polyacrylates such as polymethacrylate, and polysaccharides such as starches. Exemplary polymers that can be used as the carrier component of the fragrance dispenser include olefinic polymers such as olefinic thermoplastic polymers. Exemplary olefinic thermoplastic polymers include polyethylene and polypropylene. It is expected that several of the polymers available from RTP Company of Winona, Minn.

The carrier component of the fragrance dispenser can be provided in an amount so that the fragrance dispenser remain as a solid during use of the fragrance dispenser and so that the carrier component does not transfer to the fabric or laundry dried in the dryer. It should be understood that the reference to a solid form means that the fragrance dispenser does not melt or flow onto fabric or laundry dried in the dryer. The fragrance dispenser can be provided in forms that may be considered soft, rubbery, flexible, hard, rigid, etc. The fragrance dispenser can include the carrier component in an amount sufficient so that the fragrance dispenser remains as a solid and the carrier component does not flow onto the fabric during a drying operation. By way of example, the fragrance dispenser can include the carrier component in an amount of about 30 wt. % to about 90 wt. %, about 40 wt. % to about 80 wt. %, or about 50 wt. % to about 70 wt. %.

The fragrance component that can be used in the fragrance dispenser includes those fragrances that are compatible with the carrier component. In the case of a single use fragrance dispenser, it is desirable for the fragrance component to remain in the fragrance dispenser until the fragrance dispenser is placed within a dryer and achieves the activation temperature that causes the fragrance component to transfer from the fragrance dispenser to the laundry. In the case of a multiple use fragrance dispenser, it is desirable for the fragrance component to be sufficiently compatible with the polymer component so that a dose of fragrance is dispensed from the fragrance dispenser during each of the drying cycles in which the fragrance dispenser is used.

The fragrance component can include volatile components and mixtures of volatile components. In general, the fragrance component can include any fragrance that is compatible with the carrier component and releases from the fragrance dispenser during operation of a dryer to impart a residual fragrance to the fabric dried in the dryer in the presence of the fragrance dispenser. Exemplary volatile components include esters, ethers, aldehydes, alcohols, nitrites, unsaturated hydrocarbons (e.g., terpenes), etc. The fragrance component can be provided having various scents including lemon, lime, orange, and musk.

The fragrance component is responsible for imparting a desired smell to the textiles or laundry. The fragrance may be any fragrant substance or mixture of substances, including natural and synthetic substances that provide a favorable aroma. In addition, the fragrance may contain auxiliary materials such as fixatives, extenders, stabilizers, and solvents. Examples of suitable fragrances include, but are not limited to, silicon oils, essential oils, absolutes, resinoids, resins, and synthetic perfume components such as hydrocarbons, alcohols, aldehydes, ketones, ethers, acids, esters, acetals, ketals, nitrites, including saturated and unsaturated compounds, aliphatic, carbocyclic and heterocyclic compounds. Additional examples of the fragrances include geraniol, geranyl acetate, linalool, linaly acetate, tetrahydrolinalool, citronellol, citronellyl acetate, dihydromyrcenol, dihydromyrcenyl acetate, tetrahydromyrcenol, terpineol, terpinyl acetate, nopol, nopyl acetate, 2-phenylethanol, 2-phenyl-ethyl acetate, benzyl alcohol, benzyl acetate, benzyl salicylate, benzyl benzoate, styrallyl acetate, amyl salicylate, dimethylbenzylcarbinol, trichloromethylphenylcarbinyl methylphenylcarbinyl acetate, p-tert-butyl-cyclohexyl acetate, isononyl acetate, vetiveryl acetate, vetiverol, alpha-n-amylcinammic aldehyde, alpha-hexyl-cinammic aldehyde, 2-methyl-3-(p-tert-butylphenyl)-propanal, 2-methyl-3-(p-isopropyl-phenyl)propanal, 3-(p-tert-butylphenyl)propanal, tricyclodecenyl acetate, tricyclodecenyl propionate, 4-(4-hydroxy-4-methylpentyl)-3-cyclohexenecarbaldehyde, 4-(4-methyl-3-pentenyl)-3-cyclohexenecarbaldehyde, 4-acetoxy-3-pentyltetrahydropyran, methyl dihydrojasmonate, 2-n-heptylcyclopentanone, 3-methyl-2-pentyl-cyclopentanone, n-decanal, n-dodecanal, 9-decenol-1,phenoxyethyl isobutyrate, phenylacetaldehyde dimethyl acetal, phenylacetaldehyde diethyl acetal, gerano-nitrile, citronellonitrile, cedryl acetal, 3-isocam-phylcyclohexanol, cedryl methyl ether, isolongifolanone, aubepine nitrile, aubepine, heliotropine, coumarin, eugenol, vanillin, diphenyl oxide, hydroxycitronellal ionones, methyl ionones, isomethyl ionomes, irones, cis-3-hexenol and esters thereof, indane musk fragrances, tetralin musk fragrances, isochro-man musk fragrances, macrocyclic ketones, macrolactone musk fragrances, ethylene brassylate, aromatic nitro-musk fragrances.

It should be recognized that certain fragrances may include additional components that function as, for example, carriers, diluents, stabilizers, etc. Exemplary additional components include glycols and vegetable oils. The reference to the fragrance component includes the fragrance as well as any additional component combined with the fragrance to provide a beneficial property such as stability, viscosity, etc.

Examples of suitable fragrances, or perfumes, are provided in U.S. Pat. No. 5,234,610, which is herein incorporated by reference.

The fragrance dispenser can include as much of the fragrance component as desired to achieve a fragrance dispenser that provides the desired dose during each drying cycle in which the fragrance dispenser is used and provides the fabric dried in the presence of the fragrance dispenser with a residual fragrance. In general, it may be desirable to maximize the amount of the fragrance component in the fragrance dispenser to prolong the useful life of the fragrance dispenser. In addition, too much of the fragrance component in the fragrance dispenser may cause the fragrance dispenser to lose its desired release properties or may cause the fragrance dispenser to dispense the carrier component onto fabric during a drying cycle. By way of example, the fragrance dispenser can include about 10 wt. % to about 70 wt. % of the fragrance component. In addition, the fragrance dispenser can include about 20 wt. % to about 60 wt. % of the fragrance component. Furthermore, the fragrance dispenser can include about 30 wt. % to about 50 wt. % of the fragrance component.

It should be understood that certain carrier components and certain fragrance components may not be compatible. There may exist some level or degree of incompatibility between a particular carrier component and a particular fragrance component. That is, all possible carrier components may not be compatible with all possible fragrance components. One skilled in the art would understand how to select the carrier component and the fragrance component to provide a fragrance dispenser that dispenses a desired amount or dose of the fragrance component to fabric dried in a dryer to impart a residual fragrance.

The carrier component and the fragrance component can be selected so that the fragrance dispenser resists dispensing fragrance at room temperature and provides for the dispensing of a desired amount of fragrance to impart a residual fragrance to the fabric as a result of a drying cycle in a laundry dryer once an activation temperature is achieved. While the fragrance dispenser can be characterized as resisting the dispense of fragrance at room temperature, it is expected that some amount of fragrance can be dispensed at room temperature. For a given fragrance dispenser, the amount of the fragrance component dispensed at room temperature can be characterized by a release rate "x" (mass per unit time). Room temperature is about 70° F. to about 75° F. When the fragrance dispenser is placed in a laundry dryer and allowed to proceed during a drying cycle, the fragrance dispenser can dispense the fragrance component at a rate of at least about 5x. This characterization refers to an amount released during the drying cycle that is 5 times greater than the amount released at room temperature. Preferably, the amount released is at least 10 times, more preferably at least about 50 times, and even more preferably at least about 100 times greater than the amount released at room temperature. It should be understood that a fragrance dispenser intended for home style dryers will provide these dispensing rates at a use temperature (temperature within a dryer) of at least about 100° F., and the fragrance dispenser for use in industrial laundry dryers will achieve this dispensing rate at a use temperature of at least about 170° F.

The fragrance dispenser can be provided in various shapes and sizes. The size of the fragrance dispenser can be sufficiently large so that it does not fall through the vent holes provided in a laundry dryer. In the case of a home style laundry dryer, it is expected that the fragrance dispenser will have a size of at least about 1 inch diameter. For a single use fragrance dispenser, the fragrance dispenser can have a size that allows it to be conveniently placed in a dryer and so that the desired amount of fragrance can be released from the fragrance dispenser during a drying cycle. A single use fragrance dispenser can have a size of at least about 2 grams. A single use fragrance dispenser can have a size of less than about 10 grams. A multiple use fragrance dispenser can have a size that is sufficient to allow a desired dose of fragrance to be released from the fragrance dispenser during multiple cycles in a laundry dryer. A fragrance dispenser that can achieve multiple dispensing of a desired dose to laundry during a drying cycle can have a size of at least about 10 grams, or a size of at least about 20 grams. It is generally desirable that the laundry dispenser is not too large and can be easily manipulated and does not cause a disruption during the drying operation. Accordingly, the fragrance dispenser can have a size of less than about 500 grams.

The fragrance dispenser can be provided so that it is free flowing within the dryer or mounted within the dryer. In the situation where the fragrance dispenser is free flowing, it can be tossed into the dryer with the laundry and allowed to mix with the laundry. In the case where the fragrance dispenser is mounted within the dryer, it can be placed on an interior surface of the dryer. The interior surface can be a fin of the dryer or it can be some other wall surface such as, for example, the door, an end wall, a glass window, a part of the drum that rotates, etc. The fragrance dispenser can be provided with a substrate that attaches to a cradle attached to an interior surface within the dryer. Exemplary cradles that attach to an interior surface within a dryer are disclosed in, for example, U.S. Pat. No. 6,779,740 to Lentsch et al.; U.S. patent application Publication No. US 2003/0192197 to Griese et al.; U.S. patent application Publication No. US 2004/0089731 to Griese et al.; U.S. patent application Publication No. US 2004/0159717 to Griese et al.; U.S. patent application Publication No. US 2004/0159718 to Griese et al.; and U.S. patent application Publication No. US 2005/0045736. The disclosure of each of these publications is incorporated herein by reference in its entirety.

The fragrance dispenser can be formulated so that a desirable amount of the fragrance component is provided in the fragrance dispenser. Because the fragrance component can be relatively volatile, it may be desirable to formulate the fragrance dispenser under conditions that reduce the extent of loss of the fragrance component. Exemplary solidification techniques for formulating the fragrance dispenser include polymerizing and crosslinking the carrier component to form a solid. For example, monomer components can be polymerized. The polymerization can be initiated by a chemical initiator or a photo initiator. Crosslinking of oligomers or polymers can result in solidification. The composition can be extruded to a desired shape, extruded into a mold, or cast into a mold. The mold can be provided having a desired shape.

The fragrance dispenser can be provided so that it does not include other laundry conditioners such as softening agents, anti-static agents, anti-wrinkle agents, and color protection agents. To the extent the fragrance dispenser may include components that can be considered "other laundry conditioners" it should be understood that those components can be excluded to an extent so that their effect as laundry conditioners is not achieved over the life of the fragrance dispenser. Preferably, the amounts of other "laundry conditioners" can be controlled to an extent that the laundry conditioners do not provide laundry conditioning effect after a single use or cycle of the fragrance dispenser. That is, if a component that can be characterized as a softening agent is incorporated into the fragrance dispenser, the amount of the softening agent should be sufficiently low so that the fragrance dispenser does not impart a softening effect to laundry dried in the presence of the fragrance dispenser after the first use or cycle of the fragrance dispenser. In addition, the fragrance dispenser can exclude an amount of the "other laundry conditioners" in amounts above their effective amounts for imparting their properties to laundry.

The above specification provides a complete description of the manufacture and use of the invention. Since many embodiments of the invention can be made without departing from the spirit and scope of the invention, the invention resides in the claims hereinafter appended.

We claim:

1. A method for dispensing fragrance onto laundry in a dryer comprising:

(a) drying fabric in an automatic dryer in the presence of a fragrance dispenser at a temperature of at least about 100° F. to provide release of fragrance from the fragrance dispenser to impart a residual fragrance to the fabric, wherein the fragrance dispenser comprises a mixture of a carrier component and a fragrance component provided in a solid form wherein the carrier component is comprised of a polymer, and (b) the carrier component polymer is selected so that the fragrance component is released from the fragrance dispenser at 100° F. at a rate of at least five times greater than the rate of 70° F.

(c) wherein the fragrance dispenser comprises a substrate that attaches to a cradle provided on an interior surface within a dryer.

2. A method according to claim 1, wherein the solid form has a size of about 2 grams to about 10 grams.

3. A method according to claim 1, wherein the solid form has a size of about 10 grams to about 500 grams.

4. A method according to claim 1, wherein the fragrance dispenser dispenses the fragrance component at a temperature of at least 100° F. that is at least fifty times greater than the rate at 70° F.

5. A method according to claim 1, wherein the fragrance dispenser comprises about 30 wt. % to about 90 wt. % of the fragrance component.

6. A method according to claim 1, wherein the fragrance dispenser comprises about 40 wt. % to about 80 wt. % of the fragrance component.

7. A method according to claim 1, wherein the fragrance component comprises at least one of silicon oils, essential oils, absolutes, resinoids, resins, or synthetic perfume components.

8. A method according to claim 7, wherein the fragrance component comprises the synthetic perfume components, and wherein the synthetic perfume component comprises at least one of hydrocarbons, alcohols, aldehydes, ketones, ethers, acids, esters, acetals, ketals, or nitrites.

9. A method according to claim 1, wherein the fragrance dispenser comprises about 30 wt. % to about 90 wt. % of the carrier component.

10. A method according to claim 1, wherein the fragrance dispenser comprises about 40 wt. % to about 80 wt. % of the carrier component.

11. A method according to claim 1, wherein the carrier component comprises at least one of polyamide, polyolefin, functionalized polyolefin, polyacrylate, or polysaccharide.

12. A method according to claim 1, wherein the residual fragrance is sufficient so that six of nine panelists correctly identify a towel from a group of three towels that is different according to a triangle test performed 24 hours after the step of drying the towels and wherein the fabric comprises the towels.

13. A method according to claim 1, wherein the carrier component is selected so that it does not flow onto the fabric at a drying temperature up to about 170° F.

14. A method according to claim 1, wherein the carrier component is selected so that it does not flow onto the fabric at a drying temperature up to about 240° F.

* * * * *